US010301954B2

(12) United States Patent
Allen et al.

(10) Patent No.: US 10,301,954 B2
(45) Date of Patent: May 28, 2019

(54) TURBINE AIRFOIL TRAILING EDGE COOLING PASSAGE

(71) Applicant: General Electric Company, Schenectady, NY (US)

(72) Inventors: Jason Randolph Allen, Loveland, OH (US); Robert Alan Frederick, West Chester, OH (US); Robert David Briggs, West Chester, OH (US); Michael Ray Tuertscher, Fairfield, OH (US)

(73) Assignee: General Electric Company, schenectady, NY (US)

( * ) Notice: Subject to any disclaimer, the term of this patent is extended or adjusted under 35 U.S.C. 154(b) by 918 days.

(21) Appl. No.: 14/990,920

(22) Filed: Jan. 8, 2016

(65) Prior Publication Data

US 2017/0198595 A1 Jul. 13, 2017

(51) Int. Cl.

| | |
|---|---|
| ***F01D 9/04*** | (2006.01) |
| ***F01D 9/06*** | (2006.01) |
| ***F01D 5/18*** | (2006.01) |
| ***F01D 5/28*** | (2006.01) |

(52) U.S. Cl.

CPC ..... *F01D 9/065* (2013.01); *F01D 5/186* (2013.01); *F01D 5/187* (2013.01); *F01D 5/284* (2013.01); *F01D 9/041* (2013.01); *F05D 2220/32* (2013.01); *F05D 2240/121* (2013.01); *F05D 2240/122* (2013.01); *F05D 2240/304* (2013.01);

(Continued)

(58) Field of Classification Search

CPC ..... F01D 5/186; F01D 5/187; F01D 5/284; F05D 2240/304; F05D 2300/6033; F05D 2260/202

See application file for complete search history.

(56) References Cited

U.S. PATENT DOCUMENTS

| | | | | |
|---|---|---|---|---|
| 6,241,466 | B1 * | 6/2001 | Tung | F01D 5/186 415/115 |
| 8,096,771 | B2 * | 1/2012 | Liang | F01D 5/187 415/115 |
| 8,790,084 | B2 | 7/2014 | Manning et al. | |

(Continued)

FOREIGN PATENT DOCUMENTS

WO 2014/158277 A2 10/2014

OTHER PUBLICATIONS

Extended European Search Report and Opinion issued in connection with corresponding EP Application No. 17150186.9 dated May 16, 2017.

*Primary Examiner* — Ninh H Nguyen

*Assistant Examiner* — Brian P Wolcott

(74) *Attorney, Agent, or Firm* — General Electric Company; Kristi Davidson

(57) ABSTRACT

A ceramic airfoil is provided. The ceramic airfoil may include a leading edge, a trailing edge, and a pair of sidewalls. The pair of sidewalls may include a suction sidewall and a pressure sidewall spaced apart in a widthwise direction and extending in the chordwise direction between the leading edge and the trailing edge. The pair of sidewalls may also define cooling cavity and a plurality of internal cooling passages downstream of the cooling cavity to receive a pressurized cooling airflow. The internal cooling passages may be defined across a diffusion section with a set diffusion length, and include one or more predefined ratios or angles.

17 Claims, 10 Drawing Sheets

(52) U.S. Cl.
CPC ..... *F05D 2260/202* (2013.01); *F05D 2300/6033* (2013.01)

(56) References Cited

U.S. PATENT DOCUMENTS

| | | | | |
|---|---|---|---|---|
| 9,107,026 | B1 | 8/2015 | Viswanadham et al. | |
| 9,145,773 | B2 | 9/2015 | Bergholz, Jr. et al. | |
| 2013/0259645 | A1 | 10/2013 | Bergholz, Jr. et al. | |
| 2013/0302176 | A1 | 11/2013 | Bergholz, Jr. et al. | |
| 2013/0302177 | A1* | 11/2013 | Bergholz, Jr. ..... | F01D 5/187 416/97 R |
| 2013/0302179 | A1 | 11/2013 | Bergholz, Jr. et al. | |
| 2014/0003937 | A1* | 1/2014 | Grooms ..... | F01D 5/00 416/1 |
| 2015/0147158 | A1 | 5/2015 | Wang et al. | |

* cited by examiner

TURBINE AIRFOIL TRAILING EDGE COOLING PASSAGE

FIELD OF THE INVENTION

The present subject matter relates generally to a gas turbine engine airfoil, and more particularly, to a cooling passage leading to a trailing edge of the airfoil.

BACKGROUND OF THE INVENTION

In a gas turbine engine, air is pressurized in a compressor and mixed with fuel in a combustor for generating hot combustion gases. The hot gases are channeled through various stages of a turbine which extract energy therefrom for powering the compressor and producing work. The turbine stages often include stationary metal turbine nozzles having a row of vanes that channel the hot combustion gases into a corresponding row of rotor blades. Over time, the heat generated in the combustion process can rapidly wear the turbine vanes and blades, thereby reducing their usable life. This wear can be especially pronounced at the thin trailing edge of an airfoil.

In some engines, the turbine vanes and turbine blades both have corresponding hollow airfoils that can receive cooling air. Cooling air can be directed through the airfoils before being exhausted through one or more slots near an airfoil's trailing edge. Often, the cooling air is compressor discharge air that is diverted from the combustion process. Although diverting air from the combustion process helps prevent damage to the turbine airfoils, it can decrease the amount of air available for combustion, thus decreasing the overall efficiency of the engine.

Aerodynamic and cooling performance of the trailing edge cooling slots can be related to the specific configuration of the cooling slots and the intervening partitions. The flow area of the cooling slots regulates the flow of cooling air discharged through the cooling slots, and the geometry of the cooling slots affects cooling performance thereof. For instance, the divergence or diffusion angle of a cooling slot can affect undesirable flow separation of the discharged cooling air that would degrade performance and cooling effectiveness of the discharged air. This might also increase losses that impact turbine efficiency.

Notwithstanding, the small size of the outlet lands and the cooling performance of the trailing edge cooling slots, the thin trailing edges of turbine airfoils oftentimes limit the life of those airfoils due to the high operating temperature thereof in the hostile environment of a gas turbine engine.

Accordingly, it is desired to provide an airfoil having improved durability and engine performance. It is also desired to minimize the amount of cooling flow used for trailing edge cooling and maximize fuel efficiency of the gas turbine engine.

BRIEF DESCRIPTION OF THE INVENTION

Aspects and advantages of the invention will be set forth in part in the following description, or may be obvious from the description, or may be learned through practice of the invention.

In accordance with one embodiment of the present disclosure, a ceramic airfoil is provided. The ceramic airfoil may include a leading edge, a trailing edge, and a pair of sidewalls. The trailing edge may be positioned downstream from the leading edge in a chordwise direction. The pair of sidewalls may include a suction sidewall and a pressure sidewall spaced apart in a widthwise direction and extending in the chordwise direction between the leading edge and the trailing edge. The pair of sidewalls may also define cooling cavity and a plurality of internal cooling passages downstream of the cooling cavity to receive a pressurized cooling airflow. The internal cooling passages may be defined across a diffusion section with a set diffusion length. The pressure sidewall may further include a breakout lip at a set aperture width from the suction sidewall to define an exit aperture. The internal cooling passage may include an inlet upstream from the diffusion section having a set inlet area cross section, further wherein the exit aperture includes a set breakout area cross section having a breakout ratio relative to the inlet area cross-section between about 1 and about 3.

In accordance with another embodiment of the present disclosure, a ceramic airfoil is provided. The ceramic airfoil may include a leading edge, a trailing edge, and a pair of sidewalls. The trailing edge may be positioned downstream from the leading edge in a chordwise direction. The pair of sidewalls may include a suction sidewall and a pressure sidewall spaced apart in a widthwise direction and extending in the chordwise direction between the leading edge and the trailing edge. The pair of sidewalls may also define cooling cavity and a plurality of internal cooling passages downstream of the cooling cavity to receive a pressurized cooling airflow. The internal cooling passages may be defined across a diffusion section at a constant diffusion width and expansion angle. The expansion angle may be between about 3° and about 15°. The pressure sidewall may further include a breakout lip at a set aperture width from the suction sidewall to define an exit aperture.

In accordance with yet another embodiment of the present disclosure, a ceramic airfoil is provided. The ceramic airfoil may include a leading edge, a trailing edge, and a pair of sidewalls. The trailing edge may be positioned downstream from the leading edge in a chordwise direction. The pair of sidewalls may include a suction sidewall and a pressure sidewall spaced apart in a widthwise direction and extending in the chordwise direction between the leading edge and the trailing edge. The pair of sidewalls may also define cooling cavity and a plurality of internal cooling passages downstream of the cooling cavity to receive a pressurized cooling airflow. The internal cooling passages may be defined across a diffusion section with a set diffusion length. The pressure sidewall may further include a breakout lip having a set lip width at a set aperture width from the suction sidewall. The breakout lip may include a predetermined lip ratio of lip width over aperture width. The predetermined lip ratio may be between about 0 and about 2.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
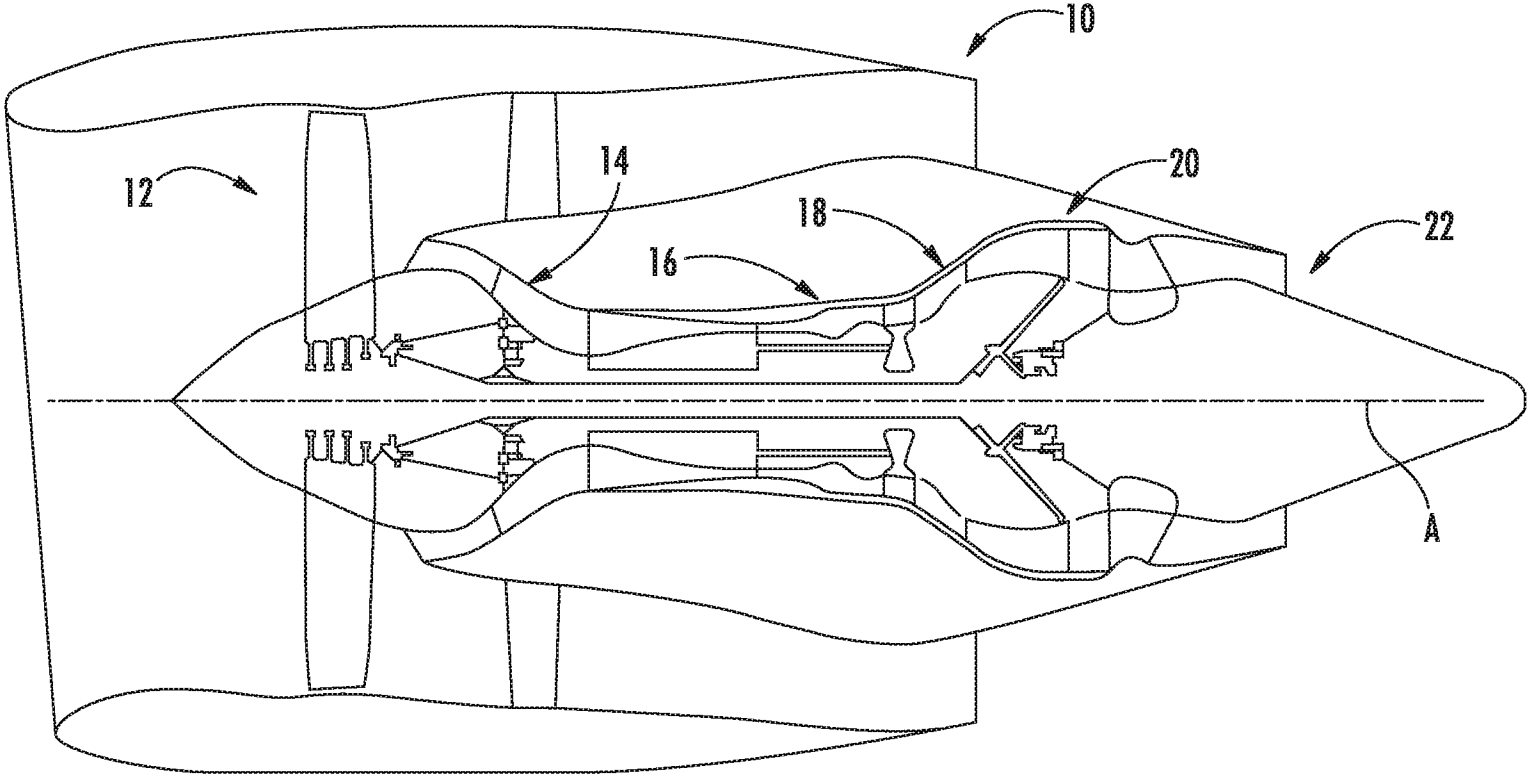
FIG. 1 provides a schematic view of an exemplary gas turbine engine embodiment according to the present disclosure.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Although reference may be made to one or more dimension, ratio, or geometry shown in a corresponding figure, it is understood that the figures are intended for illustrative purposes only, and may not be drawn to scale.

As used herein, the terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

The terms "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. "Substantially," "about," and "generally," as used herein, are all relative terms indicating as close to the desired value as can reasonably be achieved within conventional manufacturing tolerances Referring now to the drawings, FIG. 1 is a schematic cross-sectional view of an exemplary high-bypass turbofan type engine 10 herein referred to as "turbofan 10" as it can incorporate various embodiments of the present disclosure. In addition, although an exemplary turbofan embodiment is shown, it is anticipated that the present disclosure can be equally applicable to other turbine-powered engines, such as an open rotor, a turboshaft, or a turboprop configuration.

As shown, the exemplary turbofan 10 of FIG. 1 extends along a central or centerline engine axis A and includes a fan system 12, a compressor 14, a combustion stage 16, a high pressure turbine stage 18, a low pressure turbine stage 20, and an exhaust stage 22. In operation, air flows through fan system 12 and is supplied to compressor 14. The compressed air is delivered from compressor 14 to combustion stage 16, where it is mixed with fuel and ignited to produce combustion gases. The combustion gases flow from combustion stage 16 through turbine stages 18, 20 and exit gas turbine engine 10 via an exhaust 22. In other embodiments, gas turbine engine 10 may include any suitable number of fan systems, compressor systems, combustion systems, turbine systems, and/or exhaust systems arranged in any suitable manner.

Figure 2:
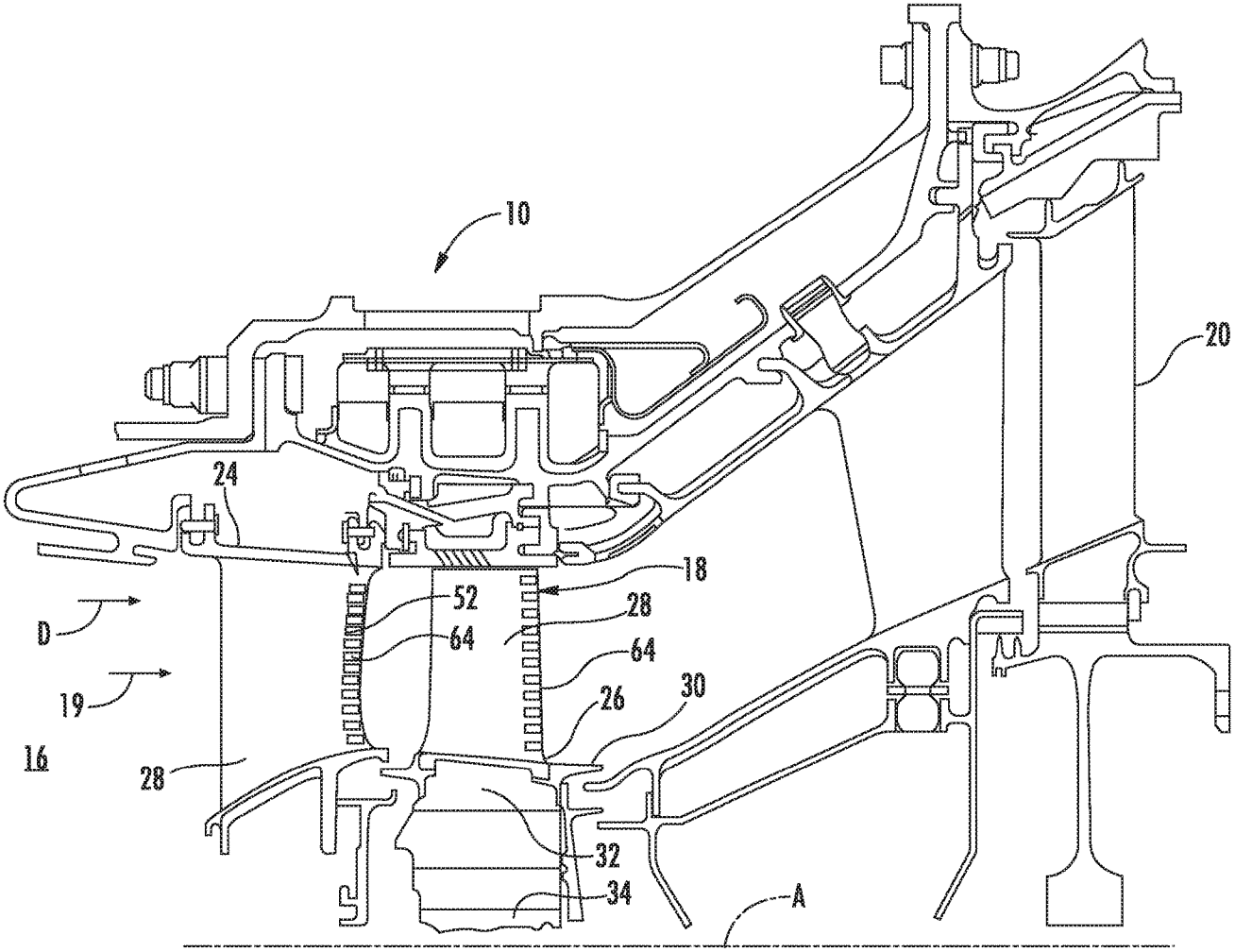
FIG. 2 provides a sectional view of an exemplary embodiment of turbine vane and rotor blade airfoils according to the present disclosure.

Illustrated in FIG. 2 is an exemplary gas turbine engine high pressure turbine stage 18 circumscribed about the central engine axis A and positioned between the combustion stage 16 and the low pressure turbine stage 20 (see FIG. 1). The high pressure turbine stage 18 includes a turbine nozzle having a row of circumferential turbine vanes 24, each vane being formed as an airfoil 28. During operation, the hot combustion gases 19 are discharged from the combustion stage 16 and through the row of vanes 24. The exemplary embodiment of the high pressure turbine 18 illustrated herein includes at least one row of circumferentially spaced apart high pressure turbine blades 26. Each of the turbine blades 26 includes an airfoil 28 fixed to a platform 30 and an axial entry dovetail 32 used to mount the turbine blade 26 on a perimeter of a supporting rotor disk 34.

Figure 3:
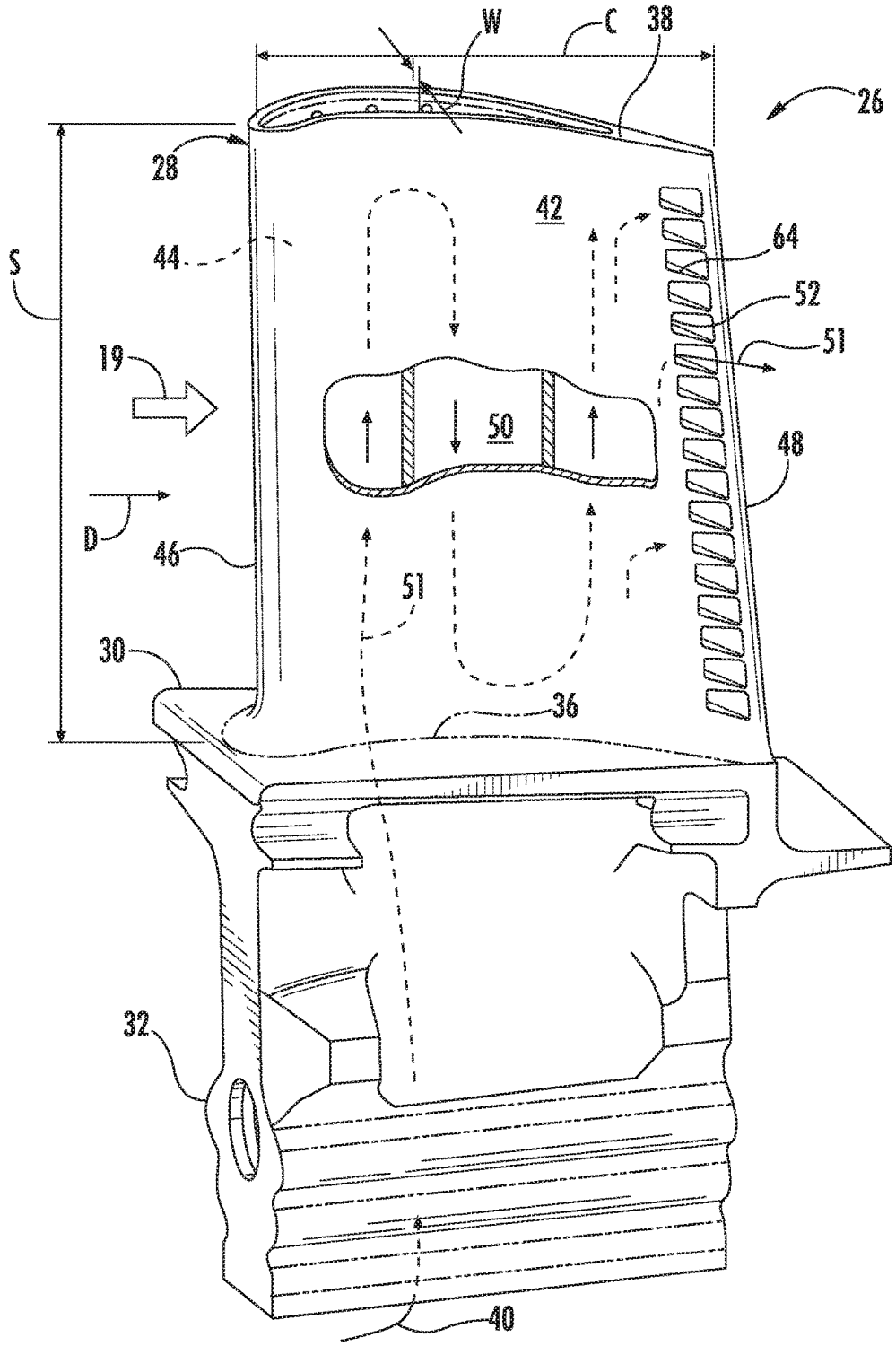
FIG. 3 provides an enlarged view of an exemplary airfoil embodiment according to the present disclosure.

Referring to FIG. 3, an exemplary airfoil 28 embodiment of a turbine blade 26 is illustrated. Although the illustrated airfoil 28 of FIG. 3 is shown as a turbine blade 26, it is understood that the discussion of an airfoil 28 may be equally applied to another gas turbine engine airfoil embodiment, e.g., a turbine vane 24 (see FIG. 2). As shown, the blade 26 extends radially outwardly along a span S from an airfoil base 36 on the blade platform 30 to an airfoil tip 38. During operation, hot combustion gases 19 are generated in the engine 10 and flow in a downstream D direction over the turbine airfoil 28 which extracts energy therefrom for rotating the disk 34 supporting the blade 26 for powering the compressor 14 (see FIG. 1). A portion of pressurized air 40 is suitably cooled and directed to the blade 26 for cooling thereof during operation.

Generally, the airfoil 28 has an oppositely-disposed pair of sidewalls 42, 44 spaced apart in a widthwise direction W. The pair of sidewalls 42, 44 includes a generally convex pressure sidewall 42 and a generally concave suction sidewall 44 that extend longitudinally or radially outwardly along the span S from the airfoil base 36 to the airfoil tip 38. The sidewalls 42, 44 also extend axially in the chordwise direction C between the leading edge 46 and the downstream trailing edge 48. The airfoil 28 is substantially hollow with the pressure sidewall 42 and suction sidewall 44 defining an internal cooling cavity or circuit 50 therein for circulating pressurized cooling air or coolant flow 51 during operation. In some exemplary embodiments, the pressurized cooling air or coolant flow 51 is from the portion of pressurized air 40 diverted from the compressor 14 (see FIG. 1) to the turbine blade 26.

The airfoil 28 increases in width W or widthwise from the airfoil leading edge 46 to a maximum width aft therefrom before converging to a relatively thin or sharp airfoil trailing edge 48. The size of the internal cooling circuit 50, therefore, varies with the width W of the airfoil 28, and is relatively thin immediately forward of the trailing edge 48 where the two sidewalls 42, 44 join together and form a thin trailing edge 48 portion of the airfoil 28. One or more spanwise extending cooling passages 52 is provided at or near the trailing edge 48 of the airfoil 28 and facilitates airfoil cooling.

In certain embodiments, one or more portion of the airfoil 28 may be formed from a relatively low coefficient of thermal expansion material, including, but not limited to, a ceramic material and/or coating on another base material. In some embodiments, the ceramic material is a matrix composite (CMC). For example, in an example embodiment, the suction sidewall 44 and the pressure sidewall 42 are each formed from a CMC to define the internal cooling passages 52. Advantageously, this may increase the potential operating temperatures within the engine and allow higher engine efficiency to be realized. Moreover, in some embodiments, advantageous geometries may be achieved without rendering the airfoil unsuitable for use in a high-temperature region of a gas turbine engine.

Figure 4:
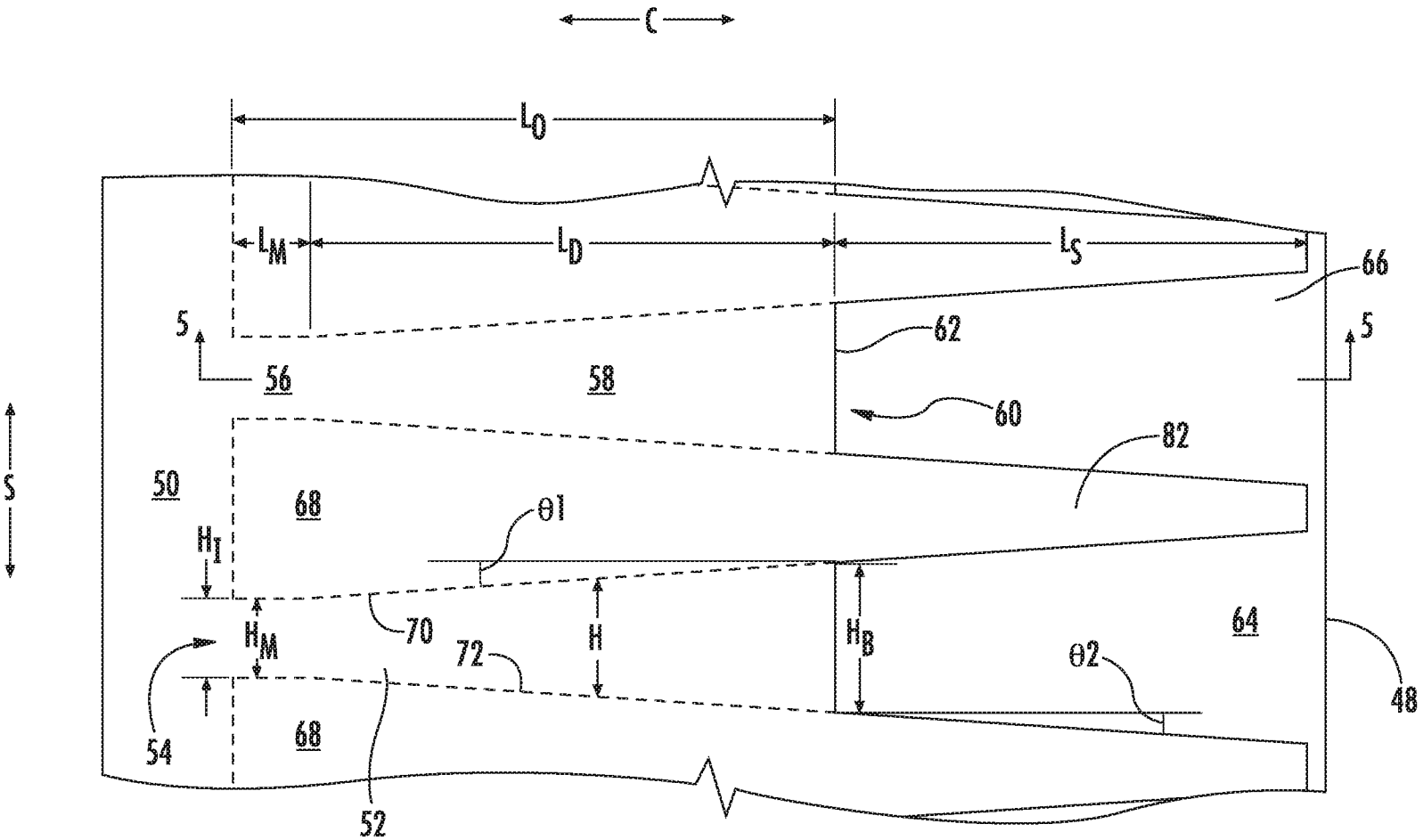
FIG. 4 provides a sectional view of the exemplary embodiment of internal cooling passages illustrated in FIG. 3.
Figure 5:
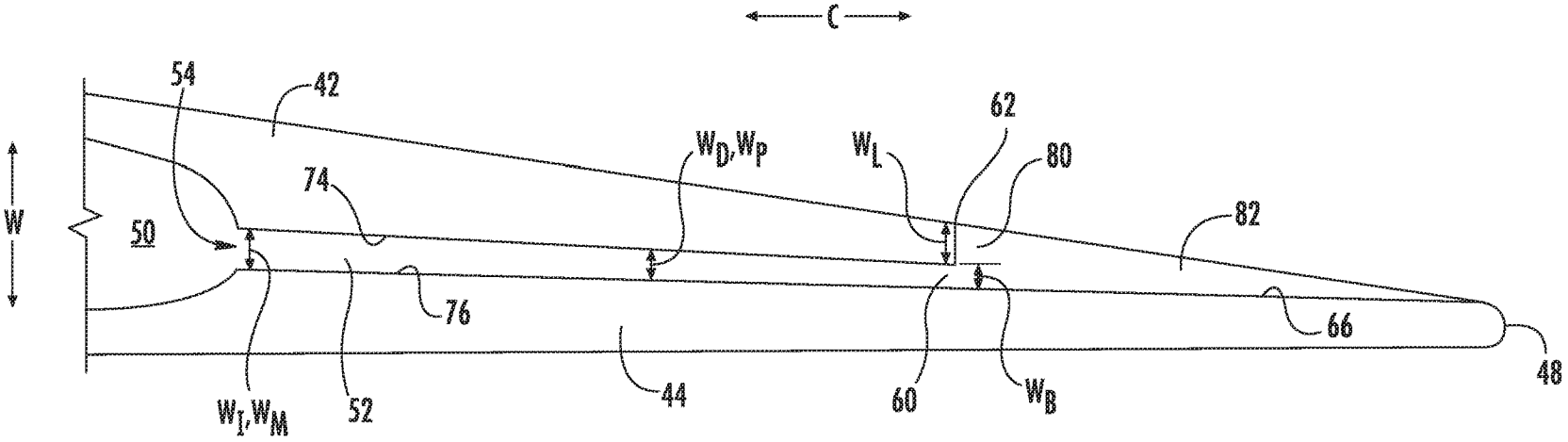
FIG. 5 provides a cross sectional schematic view of one internal cooling passage taken through 5-5 in FIG. 4.
Figure 6:
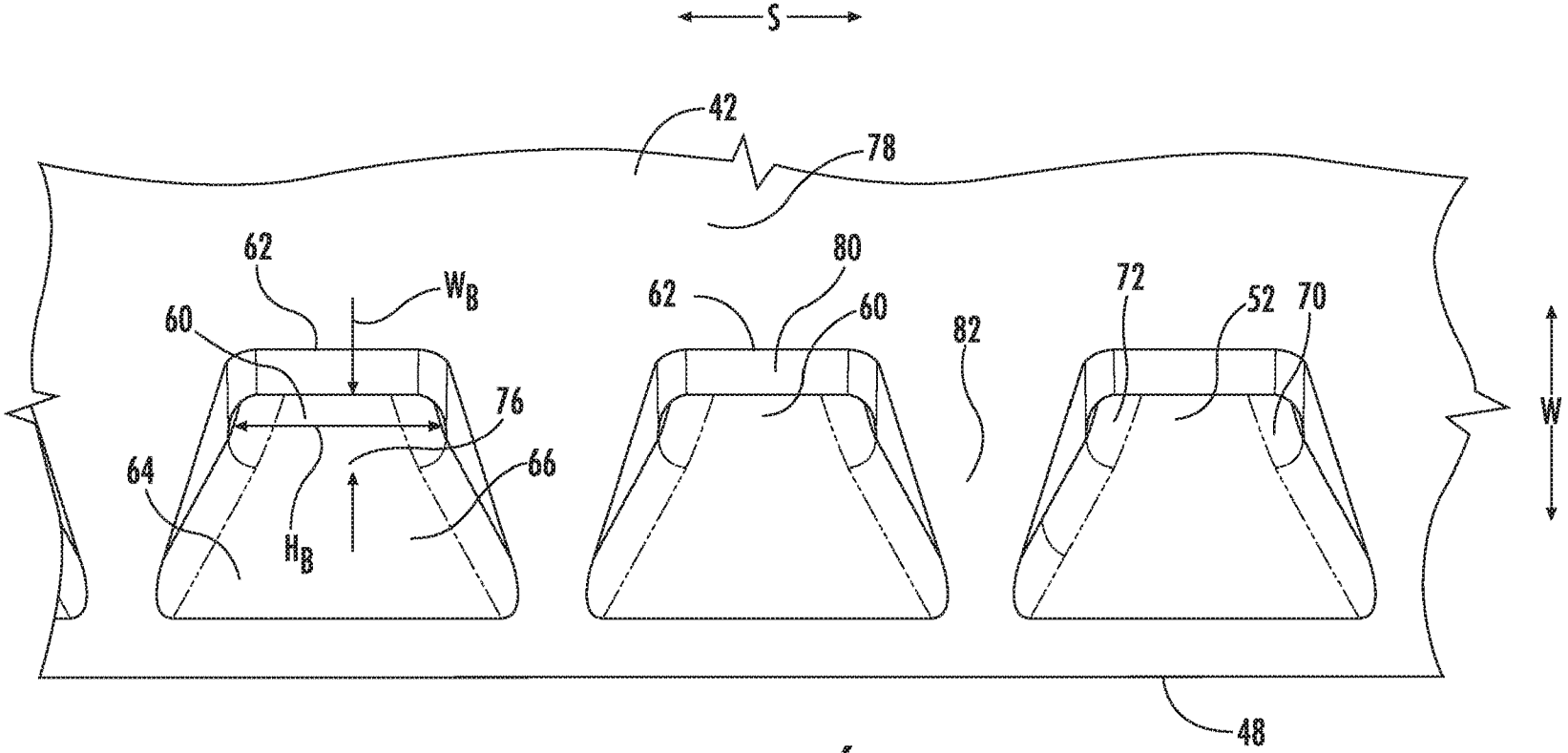
FIG. 6 provides an upstream perspective view of the internal cooling passages illustrated in FIG. 3.
Figure 7:
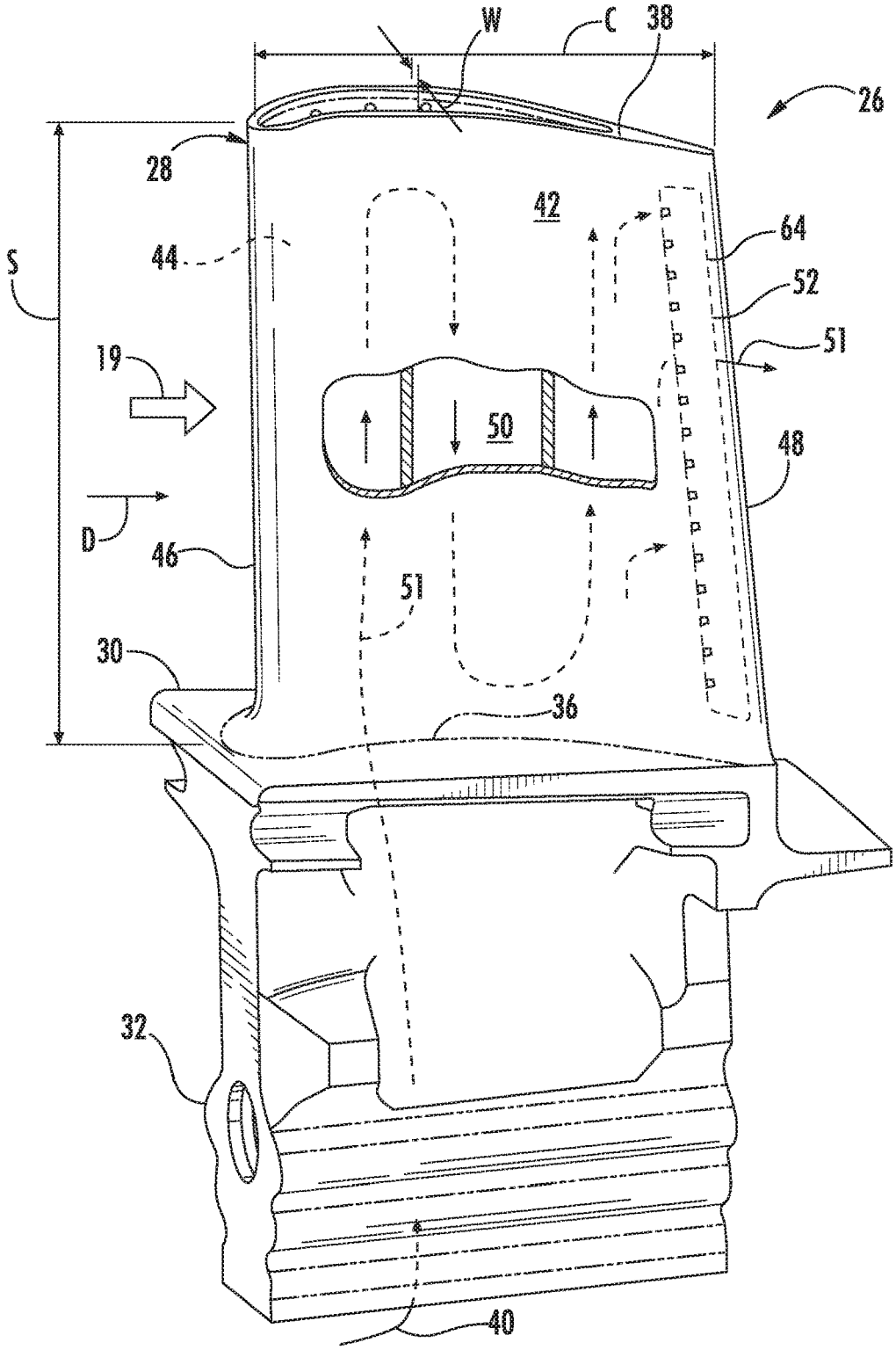
FIG. 7 provides an enlarged view of another exemplary airfoil embodiment according to the present disclosure.

Turning to the exemplary embodiment of FIGS. 4 through 6, a plurality of internal cooling passages 52 is provided and defined between the pressure sidewall 42 and the suction sidewall 44 in fluid communication with the cooling cavity 50 to direct the pressurized cooling airflow toward the downstream trailing edge 48. As shown, the plurality of cooling passages 52 is formed as a row of discrete members extending chordwise and spaced apart spanwise to define a height component H (e.g., a maximum height) and a width component W (e.g., a maximum width). Each cooling passage 52 is separated radially along the span S by corresponding axial partitions 68 that extend in the chordwise direction C toward the trailing edge 48.

As illustrated in FIG. 4, each cooling passage extends in the chordwise direction C from the cooling cavity 50 toward the trailing edge 48. Moreover, each internal cooling passage 52 includes, in downstream serial cooling flow relationship, an inlet 54, a metering section 56, and a spanwise-diverging diffusion section 58 which leads into an exit aperture 60.

Generally, the inlet 54 communicates with the cooling passage 50 to receive the cooling flow 51 (see FIG. 3). Although a straight inlet 54 is illustrated herein, alternative embodiments can include another suitable converging or non-converging geometry (e.g., a constant-converging angle mouth or a boat tail having a variable converging angle). Cooling air received at the inlet 58 is restricted through the metering section 56 before being expanded through the diffusion section 58.

After passing through the diffusion section 58, the exit aperture 60 directs air toward the trailing edge 48 across a cooling slot 64. As shown, the slot 64 has a slot floor 66 extending toward the trailing edge 48. Generally, the cooling slot 64 begins at a breakout 62 of the exit aperture 60 downstream from the diverging section 58. Optionally, the cooling slots 64 may include a slot floor 66 that is open and exposed to the hot combustion gases passing through a high pressure turbine (see also FIG. 5).

One or more heights H (e.g., maximum heights) of the cooling passage 52 is defined between an upper passage surface 70 and a lower passage surface 72 in the spanwise direction S. Each of the upper passage surface 70 and the lower passage surface 72 is formed on adjacent partitions 68. The partitions 68 may also serve to define an overall passage length $L_O$ in the chordwise direction C. As shown, the overall passage length $L_O$ may be defined between the inlet 54 and the breakout 62. As a result, the metering section 56, the diffusion section 58, and the cooling slot 64 have downstream extending lengths $L_M$, $L_D$, and $L_S$, respectively. For instance, the lengths $L_O$, $L_M$, $L_D$, and $L_S$ may each be maximum lengths in the chordwise direction C.

In some embodiments, the metering section is formed between the inlet 54 and the diffusion section 58 to have a constant height $H_M$. Moreover, the metering section 56 may be defined between two substantially parallel segments along the chordwise direction C. In other words, the upper passage surface 70 and the lower passage surface 72 will be generally parallel along the metering length $L_M$. In optional embodiments, the metering section 56 will define a constant cross sectional area, e.g., $H_M*W_M$ (see FIGS. 4 and 5), through which air may flow.

Generally, the diffusion section 58 may have a constant diffusion or expansion angle θ1 configured to diffuse the air flowing through the cooling passages 52. As shown, the expansion angle θ1 is defined along the upper passage surface 70 and lower passage surface 72 between the metering section 56 and the exit aperture 60. As a result, in some embodiments, the height H of the cooling passages 52 will generally increase along the chordwise direction C between the metering section 56 and the exit aperture 60, i.e., along the diffusion length $L_D$.

Optionally, the expansion angle θ1 may be defined relative to the chordwise direction C substantially parallel to the central engine axis A (see FIG. 2). In some embodiments, the expansion angle θ1 may be substantially the same for each cooling passage 52. Certain embodiments of the expansion angle θ1 are defined at an angle between about 3° and about 15°. Further embodiments of the expansion angle θ1 are defined at angle less than 5°, between about 3° and about 5°. Other embodiments of the expansion angle θ1 are defined at angle greater than 11°. Advantageously, the described angle geometries may permit attached and stable coolant flow and/or reduce the probability of flow stall of through the cooling passages 52. Moreover, they may be provided without detrimentally impacting the structural integrity or durability of the airfoil trailing edge in a way that might render the airfoil suitable for use in a gas turbine engine.

Turning to FIG. 5, each cooling passage 52 defines one or more width W (e.g., maximum width) in the widthwise direction. For instance, the metering section 56 and diffusion section 58 (see FIG. 4) may each include a width component ($W_M$ and $W_D$, respectively) between internal surfaces 74, 76 of the pressure and suction sidewalls 42, 44. In some embodiments, a set passage width $W_P$ is defined as a constant between the internal pressure surface 74 and the internal suction surface 76. In such embodiments, the metering section width $W_M$ will be equal to the diffusion section width $W_D$.

Although the cooling passages 52 may be formed to various suitable dimensions, certain embodiments of the cooling passage 52 are formed to maintain one or more predetermined ratios within the passage. In some embodiments, this includes a metering length ratio R1 between the set metering length $L_M$ and the constant passage width $W_P$ across the cooling passage 52, i.e., R1=$L_M/W_P$. Generally, the metering length ratio is between about 2 and about 3.

With respect to FIGS. 4 and 5, and in additional or alternative embodiments, the cooling passages 52 may be formed to include a predetermined a diffusion ratio R2 between the diffusion length $L_D$ of the diffusion section 58 and the constant width $W_P$ across the cooling passage 52, i.e., R2=$L_D/W_P$. Specifically, the diffusion ratio may be predetermined to form a ratio of between about 4 and about 40. In some embodiments, the diffusion ratio is greater than 25, between about 25 and about 40. In select embodiments, the diffusion ratio is between about 25 and about 35. In further embodiments, the diffusion ratio is about 32. Advantageously, these ratios R1, R2 may decrease the probability of flow stall and meter coolant flow 51 without detrimentally affecting airfoil wear, as might occur in existing airfoils.

At the breakout 62, the pressure sidewall 42 defines a breakout lip 80 extending in the widthwise direction W between the external pressure surface 78 and the internal pressure surface 74. As a result, the breakout lip 80 includes a width $W_L$ that bounds the exit aperture 60 at least one side. Together, the breakout lip 80 and the internal suction surface 76 define the exit aperture 60 with the upper and lower passage surfaces 70, 72. As a result, the exit aperture 60 may include an aperture width $W_B$ extending between the internal suction surface 76 and the lip 80. As noted above, the cooling passage width $W_P$ may be substantially constant. In such embodiments, the aperture width $W_B$ will be set equal to the passage width $W_P$. In other words, the aperture width $W_B$ may be the same as the passage width $W_P$.

Another predetermined ratio might be formed between the breakout lip 80 and the width $W_B$ of the cooling passage 52 at the exit aperture 60. Optional embodiments include a predetermined lip R3 ratio of the breakout lip width $W_L$ and the cooling passage width $W_P$, i.e., R3=$W_L/W_B$. Specifically, in some embodiments the predetermined lip ratio is less than 2, between about 0 and about 2. In further embodiments, the predetermined lip ratio is less than 1, between about 0.5 and about 1.0. In still further embodiments, the predetermined lip ratio is less than 0.5 between about 0 and about 0.5. The aforementioned lip ratios may facilitate advantageous film cooling without rendering the airfoil 28 unstable and unsuitable for high-temperature operations.

As noted above, and shown with respect to FIGS. 4 through 6, some embodiments of the cooling passage 52 have a fixed or constant width $W_P$ between the cooling cavity 50 and the exit aperture 60 (i.e., along the overall passage length $L_O$). In such embodiments, the width $W_D$ of the diffusion section 58 and the width $W_M$ of the metering section 56 are both constant and equal. Moreover, the inlet 54 defines an inlet cross-sectional area, i.e., inlet area cross section, having a set inlet width $W_I$ and inlet height $H_I$ that extend as a constant cross-sectional area through the metering length $L_M$. In other words, in some embodiments, the inlet width $W_I$ is equal to the metering width $W_M$ while the inlet height $H_I$ is equal to the metering height $H_M$.

As shown, in some embodiments, the internal pressure surface 74 and the internal suction surface 76 are each parallel through the entire metering and diffusion lengths $L_M$, $L_D$. In some embodiments, the internal pressure surface 74 is flat or planar through the entire metering and diffusing sections 56, 58 and their corresponding metering and diffusion lengths $L_M$, $L_D$ of the cooling passage 52. Similarly, in additional or alternative embodiments, the internal suction surface 76 is flat or planar through the entire metering and diffusion sections 56, 58 and their corresponding metering and diffusion lengths $L_M$, $L_D$. Moreover, each cooling passage 52 may be substantially free of obstructions or diversions. As a result, each cooling passage 52 may form a singular unobstructed passage from the cooling cavity 50 to the exit aperture 60. In addition, each cooling slot 64 may be similarly free from obstruction for the flow of air to the trailing edge 48.

In the illustrated embodiments of FIGS. 4 through 6, the slot floor 66 is coplanar with the internal suction surface 76 in the cooling passage 52. Optionally, the transition between the internal suction surface 76 and the slot floor may be substantially smooth, free of any steps or breaks. In additional or alternative embodiments, the inlet 54, the metering section 56, and the diffusion section 58 have the same passage width $W_P$ (i.e., have an equal constant width) in the embodiment of the internal cooling passages 52, as illustrated in FIG. 5.

As illustrated in FIG. 6, the exit aperture 60 includes a breakout area cross-section defined in the widthwise direction W and the spanwise direction S. The aperture width $W_B$ or width of the breakout area cross-section extends between the breakout lip 80 and the internal suction surface 76 at the exit aperture 60. The height of the exit aperture, or breakout height, $H_B$ in the spanwise direction S extends between the upper and lower passage surfaces 70, 72 at the exit aperture 60.

With respect to FIGS. 4 through 6, in certain embodiments, a predetermined breakout ratio R4 may be formed between the breakout area and the inlet area, i.e., R4=$(W_B*H_B)/(W_I*H_I)$. Optionally, the breakout ratio may be configured to enhance the aerodynamic properties of coolant flow 51 (see FIG. 3) through the internal cooling passages 52 (e.g., prevent stall) while limiting air exhausted at the exit aperture 60. For instance, some embodiments include a breakout ratio between about 1 and about 3 to advantageously expand the coolant flow 51. In further embodiments, the breakout ratio is less than 2.5. For instance, the breakout ratio of certain embodiments is between about 1 and about 2. In still further embodiments, the breakout ratio is between about 0.5 and about 1.

As shown in FIGS. 4 through 6, some embodiments of the airfoil 28 include a plurality of lands 82 disposed spanwise between adjacent cooling slots 64 and extending across the cooling slot length $L_S$. The lands 82 may be formed integrally with the suction sidewall 44 and/or partitions 68 to extend in the chordwise direction C. Additionally or alternatively, the lands may be formed integrally with the pressure sidewall 42. Generally, the lands 82 may extend across the slot floor 66 coplanar or flush with the external pressure surface 78.

As shown in FIG. 4, certain embodiments of the lands 82 include one or more land angle θ2 relative to the chordwise direction C and parallel to the central engine axis A. The land angle θ2 may be substantially equal to or different from the expansion angle θ1 of the diffusion section 58. Specifically, the land angle may be between about 0° and about 15°. In at least one embodiment, the land angle is less about 5°. In another embodiment, the land angle is about 0° (i.e., each land 82 is substantially parallel to the other lands 82 along the chordwise direction C). In yet another embodiment, the land angle is about 12°.

As shown in FIG. 5, each land 82 may be tapered to decrease in width as it extends from the breakout 62 toward the trailing edge 48. In certain embodiments, the land 82 is formed to taper along a constant angle from a point substantially flush the breakout 62 to a point substantially flush with the slot floor 66 at or near the trailing edge 48. Advantageously, the lands 82 may direct airflow across the cooling slots 64, improving aerodynamic efficiency of the cooling airflow.

Turning to FIGS. 7 through 10, another group of exemplary embodiments of an airfoil are is illustrated. It should be appreciated that the exemplary embodiments of FIGS. 7 through 10 are largely identical to the exemplary embodiments of FIGS. 3 through 6, except as otherwise indicated. For instance, the embodiments of FIGS. 7 through 10 include an inlet 54, metering section 56, and diffusion section 58 substantially similar in form and geometry to the inlet 54, metering, section, and diffusion sections 58 that are described above.

However, the embodiments of FIGS. 7 through 10 do not include any land structures, as were discussed with respect to FIGS. 3 through 6. Instead, the airfoils 28 of FIGS. 7 through 10 provide a landless cooling slot 64 wherein the suction sidewall 44 extends from the exit aperture 60 to the trailing edge 48 to define a landless slot floor 66. As shown, an unobstructed slot floor 66 forms a shared cooling slot 64 across the plurality of cooling passages 52. The slot floor 66 may remain flush with the internal suction surface 76 while the axial partitions 68 may extend in the chordwise direction C alongside the cooling passages 52 until reaching the breakout 62. In some embodiments, the aft end of the partition 68 may form a partition wall 86 that is substantially flush with each breakout 62 along the spanwise direction S. Advantageously, the described landless configurations may permit greater airflow across the slot floor 66, thus increasing heat dissipation. Moreover, the described landless embodiments may provide such advantages without generating unsuitable aerodynamic penalties.

Figure 8:
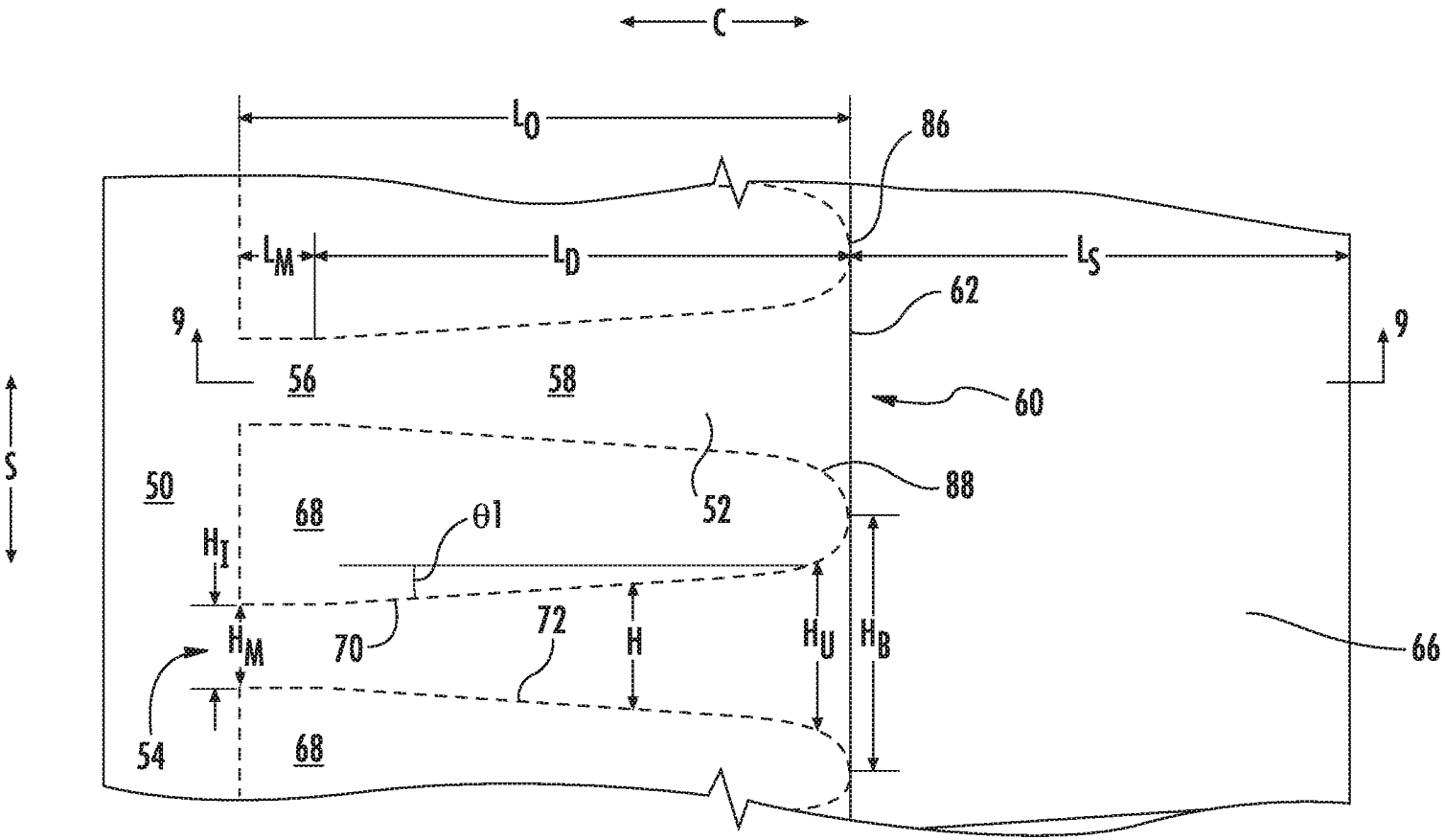
FIG. 8 provides a sectional view of the exemplary embodiment of internal cooling passages illustrated in FIG. 7.
Figure 9:
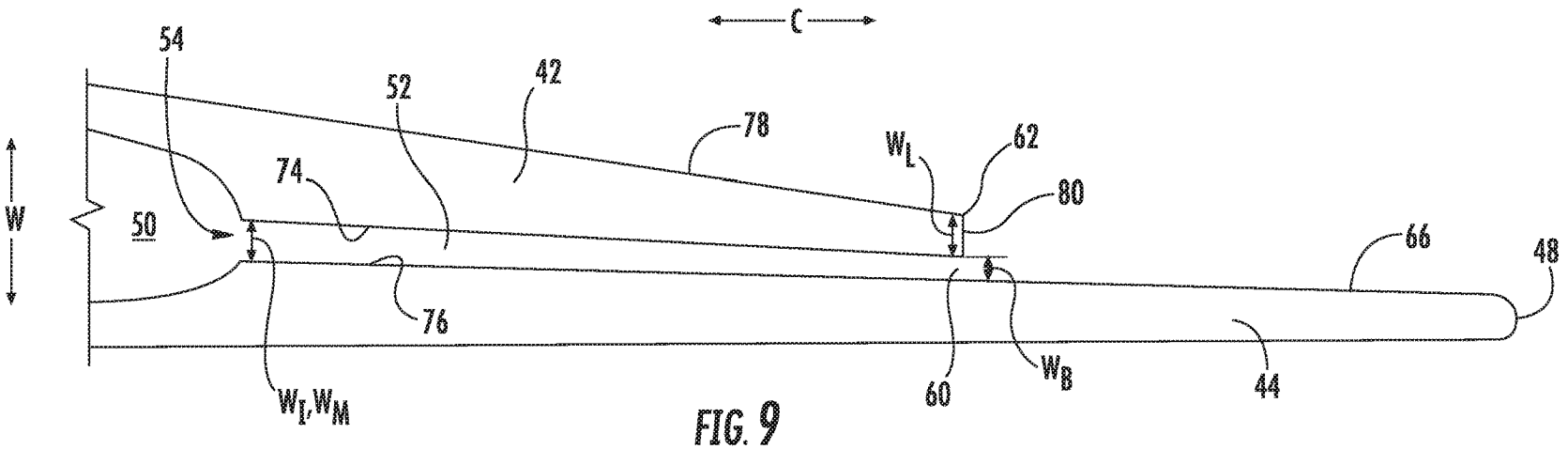
FIG. 9 provides a cross sectional schematic view of one internal cooling passage taken through 9-9 in FIG. 8.
Figure 10:
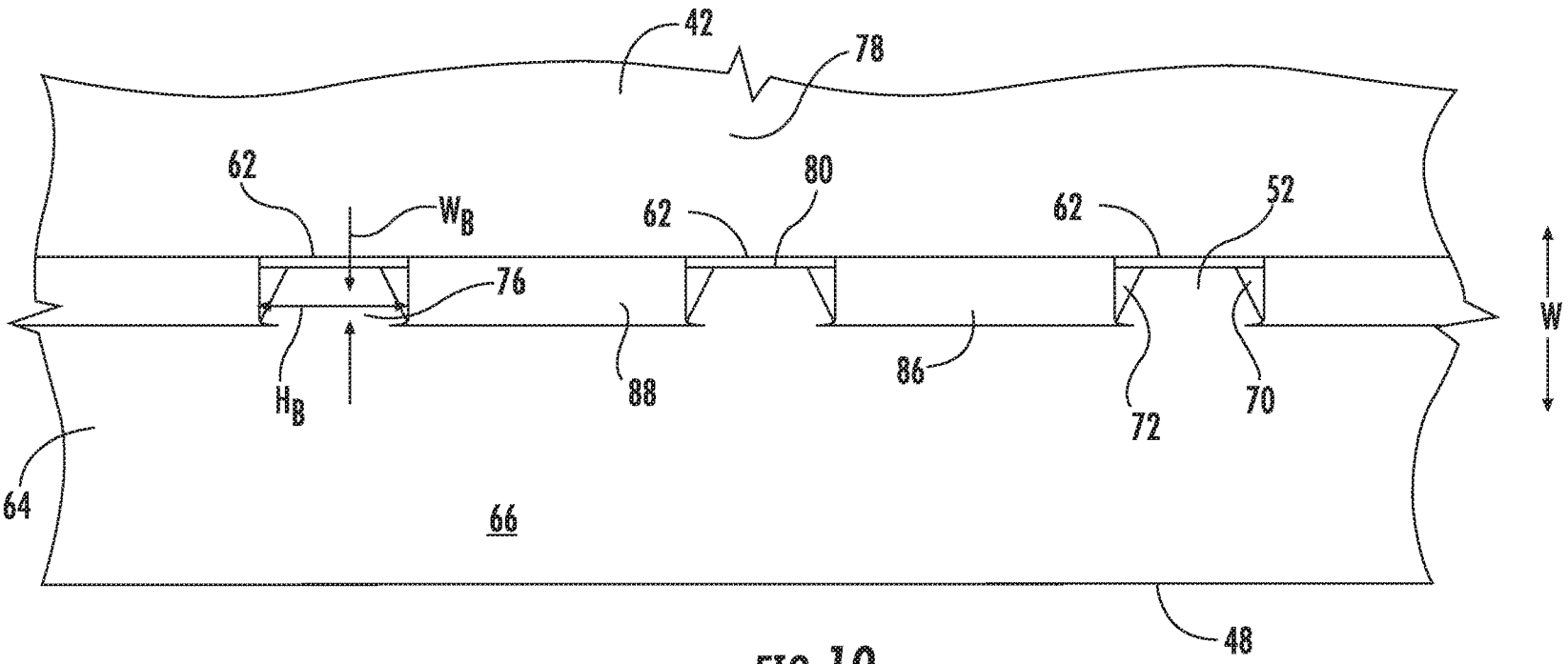
FIG. 10 provides an upstream perspective view of the internal cooling passages illustrated in FIG. 9.

As shown in FIG. 8, an aft end of the partition 68 may form a partition wall 86. In certain landless embodiments, a swept boat tail 88 may be included between the diffusion section 58 and the exit aperture 60 as part of the aft end of the partition 68. Optionally, the boat tail 88 may include a curved portion of the upper passage surface 70 and/or the lower passage surface 72. As a result, the diverging swept boat tail 88 may include a mouth height $H_U$ that increases non-linearly between the diffusion section 58 and the breakout 62. The boat tails 88 may be configured to reduce aerodynamic losses due to flow separation wakes at the exit aperture 60. The swept boat tails 88 may also be configured to facilitate flow spreading past the breakout 62 at the downstream end of the diffusion section 58. In alternative embodiments, the diffusion section 58 maintains a constant angle θ1 in the chordwise C direction until reaching the exit aperture 60 and/or breakout 62.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A ceramic airfoil comprising:

a leading edge;

a trailing edge positioned downstream from the leading edge in a chordwise direction; and a pair of sidewalls including a suction sidewall and a pressure sidewall spaced apart in a widthwise direction and extending in the chordwise direction between the leading edge and the trailing edge, the pair of sidewalls defining a cooling cavity and a plurality of internal cooling passages downstream of the cooling cavity to receive a pressurized cooling airflow, at least one internal cooling passage of the plurality of internal cooling passages being defined across a diffusion section with a set diffusion length;

wherein the at least one internal cooling passage includes an inlet upstream from the diffusion section having a set inlet area cross section, further wherein the pressure sidewall includes a breakout lip at a set aperture width from the suction sidewall to define an exit aperture including a set breakout area cross section having a breakout ratio relative to the inlet area cross-section, wherein a diffusion ratio of the diffusion length to aperture width is between about 25 and about 40, and wherein the breakout ratio is between about 1 and about 3.

2. The ceramic airfoil of claim 1, wherein the suction sidewall extends from the exit aperture to the trailing edge to define a breakout floor, and wherein the ceramic airfoil further comprises a plurality of lands disposed on the breakout floor between a plurality of exit apertures of the plurality of internal cooling passages.

3. The ceramic airfoil of claim 1, wherein the suction sidewall extends from the exit aperture to the trailing edge to define a landless slot floor.

4. The ceramic airfoil of claim 1, wherein the pressure sidewall and the suction sidewall comprise a ceramic matrix composite.

5. The ceramic airfoil of claim 1, wherein the diffusion section includes a constant expansion angle between about 3° and about 15°.

6. The ceramic airfoil of claim 1, wherein the breakout lip includes a set width having a lip ratio relative to the set aperture width, the lip ratio being between about 0 and about 2.

7. The ceramic airfoil of claim 1, wherein the ceramic airfoil is disposed within a gas turbine engine.

8. The ceramic airfoil of claim 1, wherein the at least one internal cooling passage includes a metering section having a constant height and extending between the cooling cavity and the diffusion section to define a set metering length, and wherein the ceramic airfoil further comprises a metering length ratio of the metering length to the aperture width, the metering length ratio being between about 1 and about 3.

9. The ceramic airfoil of claim 1, wherein the diffusion ratio is between about 25 and about 35.

10. A ceramic airfoil comprising:

a leading edge;

a trailing edge positioned downstream from the leading edge in a chordwise direction; and a pair of sidewalls including a suction sidewall and a pressure sidewall spaced apart in a widthwise direction and extending in the chordwise direction between the leading edge and the trailing edge, the pair of sidewalls defining a cooling cavity and a plurality of internal cooling passages downstream of the cooling cavity to receive a pressurized cooling airflow, at least one internal cooling passage of the plurality of internal cooling passages being defined across a diffusion section at a constant diffusion width and expansion angle, the expansion angle being between about 3° and about 15°;

wherein the pressure sidewall includes a breakout lip at a set aperture width from the suction sidewall to define an exit aperture, and wherein the at least one internal cooling passage includes a metering section having a constant height and extending between the cooling cavity and the diffusion section to define a set metering length, and wherein the ceramic airfoil further comprises a metering length ratio of the metering length to the aperture width, the metering length ratio being between about 1 and about 3.

11. The ceramic airfoil of claim 10, wherein the constant expansion angle is between about 3° and about 5°.

12. The ceramic airfoil of claim 10, wherein the constant expansion angle is between about 11° and about 15°.

13. The ceramic airfoil of claim 10, wherein the suction sidewall extends from the exit aperture to the trailing edge to define a slot floor, and wherein the ceramic airfoil further comprises a plurality of lands disposed on the slot floor between a plurality of exit apertures of the plurality of internal cooling passages.

14. The ceramic airfoil of claim 10, wherein the suction sidewall extends from the exit aperture to the trailing edge to define a landless slot floor.

15. The ceramic airfoil of claim 10, wherein the pressure sidewall and the suction sidewall comprise a ceramic matrix composite.

16. The ceramic airfoil of claim 10, wherein the breakout lip includes a set width having a lip ratio relative to the set aperture width, the lip ratio being between about 0 and about 2.

17. A ceramic airfoil comprising:

a leading edge;

a trailing edge positioned downstream from the leading edge in a chordwise direction; and a pair of sidewalls including a suction sidewall and a pressure sidewall spaced apart in a widthwise direction and extending in the chordwise direction between the leading edge and the trailing edge, the pair of sidewalls comprising a ceramic matrix composite and defining a cooling cavity and a plurality of internal cooling passages downstream of the cooling cavity to receive a pressurized cooling airflow, the plurality of internal cooling passages being defined across a diffusion section with a set diffusion length;

wherein the pressure sidewall includes a breakout lip having a set lip width at a set aperture width from the suction sidewall, the breakout lip having a lip ratio of lip width over aperture width, the lip ratio being between about 0 and about 0.5.

* * * * *